US007434622B2

(12) United States Patent
Luke et al.

(10) Patent No.: US 7,434,622 B2
(45) Date of Patent: Oct. 14, 2008

(54) COMPLIANT CONE FOR SOLID LINER EXPANSION

(75) Inventors: Mike A. Luke, Houston, TX (US); Simon J. Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 239 days.

(21) Appl. No.: 11/181,253

(22) Filed: Jul. 14, 2005

(65) Prior Publication Data

US 2007/0012443 A1 Jan. 18, 2007

(51) Int. Cl.
*E21B 43/10* (2006.01)
*E21B 23/00* (2006.01)

(52) U.S. Cl. ..... 166/277; 166/207; 166/216; 166/217

(58) Field of Classification Search ..... 166/277, 166/384, 206, 207, 216, 217
See application file for complete search history.

(56) References Cited

U.S. PATENT DOCUMENTS

| | | | | | |
|---|---|---|---|---|---|
| 1,981,525 | A * | 11/1934 | Price | ..... | 166/381 |
| 2,178,999 | A * | 11/1939 | Scott | ..... | 166/124 |
| 3,203,451 | A * | 8/1965 | Vincent | ..... | 138/143 |
| 3,785,193 | A | 1/1974 | Kinley et al. | | |
| 6,012,523 | A | 1/2000 | Campbell et al. | | |
| 6,457,532 | B1 | 10/2002 | Simpson | | |
| 6,648,075 | B2 | 11/2003 | Badrak et al. | | |
| 6,688,397 | B2 | 2/2004 | McClurkin et al. | | |
| 6,722,441 | B2 * | 4/2004 | Lauritzen et al. | ..... | 166/380 |
| 6,763,893 | B2 * | 7/2004 | Braddick | ..... | 166/382 |
| 7,111,680 | B2 * | 9/2006 | Duggan | ..... | 166/207 |
| 7,117,940 | B2 * | 10/2006 | Campo | ..... | 166/207 |
| 7,121,351 | B2 | 10/2006 | Luke et al. | | |
| 2001/0020532 | A1 | 9/2001 | Baugh et al. | | |
| 2003/0121655 | A1 * | 7/2003 | Lauritzen et al. | ..... | 166/207 |

(Continued)

FOREIGN PATENT DOCUMENTS

GB 2 401 127 11/2004

(Continued)

OTHER PUBLICATIONS

U.K: Search Report, GB 0613905.9, dated Nov. 10, 2006.

(Continued)

*Primary Examiner*—David J. Bagnell
*Assistant Examiner*—David Andrews
(74) *Attorney, Agent, or Firm*—Patterson & Sheridan, L.L.P.

(57) ABSTRACT

An expander tool includes segments capable of deflecting inward in response to a restriction encountered while expanding a tubular downhole. The expander tool includes an inner mandrel having a tapered surface about its outside diameter, the segments disposed around the inner mandrel with corresponding tapered surfaces in contact with the tapered surface of the inner mandrel and a compression sleeve disposed around the inner mandrel. A compressive load on the compression sleeve applies a preload force biasing the segments to a raised position on the tapered surface and hence an extended position. This preload enables expansion of the tubular with the segments in the extended position. Upon reaching the restriction, an increased pull force on the expander tool forces the segments down the tapered surface of the inner mandrel against the bias of the preload to a retracted position such that the expander tool assumes a smaller maximum outer diameter.

21 Claims, 5 Drawing Sheets

U.S. PATENT DOCUMENTS

| | | | | |
|---|---|---|---|---|
| 2003/0155118 | A1 | 8/2003 | Sonnier | |
| 2004/0016544 | A1* | 1/2004 | Braddick | 166/277 |
| 2004/0168796 | A1 | 9/2004 | Baugh et al. | |
| 2005/0194151 | A1* | 9/2005 | Dewey et al. | 166/382 |
| 2006/0196679 | A1* | 9/2006 | Brisco et al. | 166/384 |

FOREIGN PATENT DOCUMENTS

| | | |
|---|---|---|
| GB | 2 413 577 | 11/2005 |
| WO | WO 02/594796 | 8/2002 |
| WO | WO 03/006790 | 1/2003 |
| WO | WO 03/016669 | 2/2003 |
| WO | WO 2004/079157 | 9/2004 |

OTHER PUBLICATIONS

Canadian Office Action, Application No. 2,551,950, dated Aug. 14, 2007.

* cited by examiner

COMPLIANT CONE FOR SOLID LINER EXPANSION

BACKGROUND OF THE INVENTION

1. Field of the Invention

Embodiments of the invention generally relate to apparatus and methods for expanding a tubular in a wellbore. More particularly, embodiments of the invention relate to a compliant cone capable of expanding a tubular while compensating for restrictions where expansion cannot occur.

2. Description of the Related Art

Hydrocarbon wells are typically initially formed by drilling a borehole from the earth's surface through subterranean formations to a selected depth in order to intersect one or more hydrocarbon bearing formations. Steel casing lines the borehole, and an annular area between the casing and the borehole is filled with cement to further support and form the wellbore. Several known procedures during completion of the wellbore utilize some type of tubular that is expanded downhole, in situ. For example, an intermediate string of casing can hang from a string of surface casing by expanding a portion of the intermediate string into frictional contact with a lower portion of the surface casing therearound. Additional applications for the expansion of downhole tubulars include expandable open-hole or cased-hole patches, expandable liners for mono-bore wells, expandable sand screens and expandable seats.

Various expansion devices exist in order to expand these tubulars downhole. Typically, expansion operations include pushing or pulling a solid cone through the tubular in order to expand the tubular to a larger diameter based on a fixed maximum diameter of the cone. However, the solid cone provides no flexibility in the radial direction inward to allow for clearing of a restriction or obstruction. Examples of restrictions include an unexpected section of heavy weight casing having a smaller inner diameter than expected or an immovable protrusion of the adjacent formation. The restriction can cause sticking of the cone since the pull force to drive the cone past the restriction is too high. This stuck cone creates a major time consuming and costly problem that can necessitate a sidetrack of the wellbore since the cone cannot be retrieved from the well and the cone is too hard to mill up.

Thus, there exists a need for an improved compliant cone capable of expanding a tubular while compensating for restrictions where expansion cannot occur.

SUMMARY OF THE INVENTION

Embodiments of the invention generally relate to an expander tool having segments capable of deflecting inward in response to a restriction encountered while expanding a tubular downhole. The expander tool includes an inner mandrel having a tapered surface about its outside diameter and a compression sleeve disposed around the inner mandrel. The segments are disposed around the inner mandrel with corresponding tapered surfaces in contact with the tapered surface of the inner mandrel. A compressive load on the compression sleeve applies a preload force biasing the segments to a raised position on the tapered surface and hence an extended position. This preload force enables expansion of the tubular with the segments in the extended position. Upon reaching the restriction, an increased pull force on the expander tool forces the segments down the tapered surface against the bias of the preload force to a retracted position such that the expander tool assumes a smaller maximum outer diameter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to an expander tool having a segmented cone capable of deflecting inward in response to a restriction or obstruction encountered while expanding a tubular. One or more tubular members of the expander tool apply a sufficient preload force that biases the segmented cone to an extended position for expanding the tubular. Use of the tubular members themselves to provide a spring force offers a simple low profile expander tool design. While in the following description the tubular is identified as a liner and the restriction as a section of heavy weight casing, the tubular can be any type of downhole tubular, and the restriction can be any location where full expansion cannot occur. For example, the tubular may be an open hole patch, a cased hole patch or an expandable sand screen.

Figure 1:
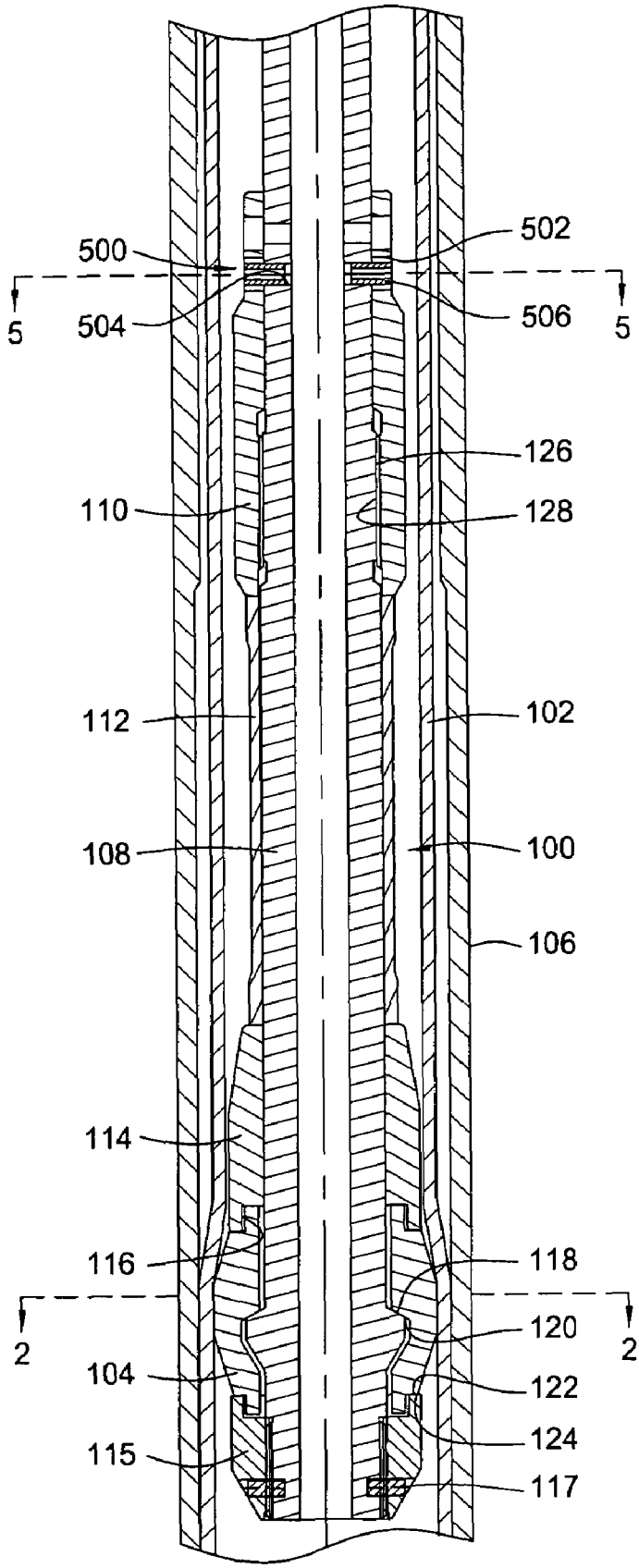
FIG. 1 is a longitudinal section view of an expander tool disposed in a liner showing cone segments of the expander tool in a fully extended position to expand the liner against an inside surface of a surrounding light weight casing.

FIG. 1 shows an expander tool 100 disposed in a liner 102 with cone segments 104 of the expander tool 100 biased to a fully extended position to expand the liner 102 against an inside surface of a surrounding light weight casing 106. The expander tool 100 includes an inner mandrel 108 having a preload sleeve 110, a compression sleeve 112, an upper holder sleeve 114, the cone segments 104 and a lower holder sleeve 115 all disposed about an outer surface thereof. A top end of the compression sleeve 112 abuts a bottom end of the preload sleeve 110 while the bottom end of the compression sleeve 112 abuts a top end of the upper holder sleeve 114. A circumferential slot 116 along an inner diameter in a bottom end of the upper holder sleeve 114 receives top ends of the cone segments 104 while bottom ends of the cone segments 104 are retained by a top end of the lower holder sleeve 115 to hold the cone segments 104 in position around the inner mandrel 108. The lower holder sleeve 115 is locked relative to the inner mandrel 108 by pins 117.

Figure 2:
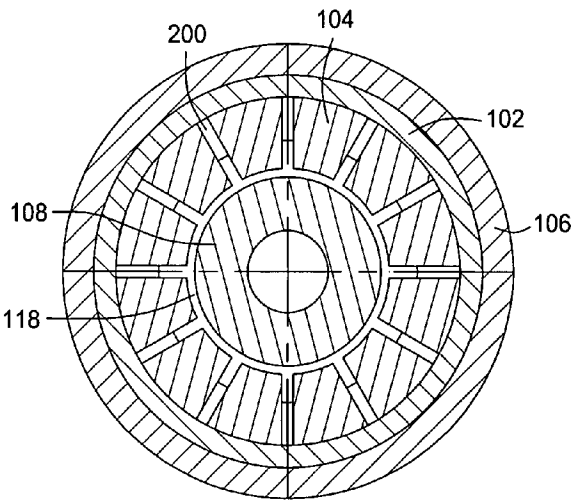
FIG. 2 is a cross section view taken across line 2-2 in FIG. 1 to illustrate arrangement of a plurality of the cone segments about an inner mandrel of the expander tool.

FIG. 2 illustrates arrangement of a plurality of the cone segments 104 about the inner mandrel 108 of the expander tool 100. For this embodiment, the expander tool 100 includes twelve of the cone segments 104, which are unconnected to one another or floating. The cone segments 104 can separate from one another by an inter-segment spacing 200 when in the extended position. As the cone segments 104 move toward the retracted position (shown in FIG. 6), the inter-segment spacing 200 reduces along with an outer diameter defined by the cone segments 104.

Figure 3:
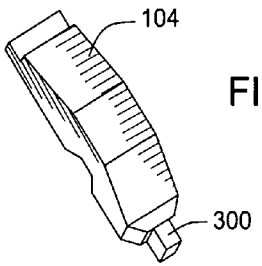
FIG. 3 is a perspective view of a top portion of one of the cone segments, which includes a tab defined by a narrowed end extension of the cone segment.
Figure 4:
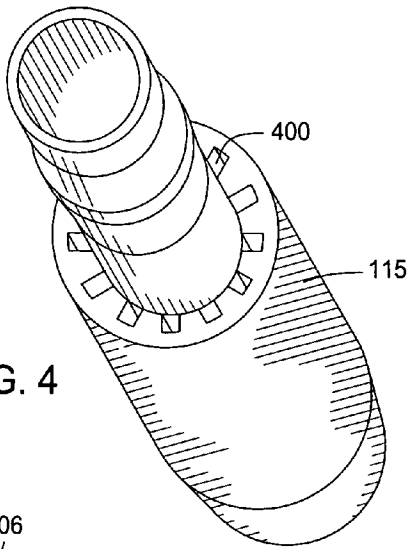
FIG. 4 is a perspective view of a bottom end of the expander tool showing a lower holder sleeve having slots in an inner diameter thereof that accommodate and guide the tabs of the cone segments once the expander tool is assembled.

FIGS. 3 and 4 show one of the cone segments 104 and the top end of the lower holder sleeve 115, respectively. The bottom end of the cone segment 104 includes a tab 300 defined by a narrowed end extension of the cone segment 104. An inner diameter of the lower holder sleeve 115 includes equidistant slots 400 corresponding in number to the cone segments 104. Each of the slots accommodates and guides the tab 300 of a corresponding one of the cone segments 104 once the expander tool 100 is assembled. Accordingly, this interrelation between the tab 300 and the slot 400 guides the cone segments 104 in a radial direction between the extended and retracted positions. For some embodiments, the tab 300 is located on the top end of the cone segments 104 such that the upper holder sleeve 114 receives the tab 300 instead of the lower holder sleeve 115.

Referring back to FIG. 1, a tapered surface 118 on an outer diameter of the inner mandrel 108 contacts corresponding tapered surfaces 120 on inner surfaces of the cone segments 104. A bias applied to the cone segments 104 in a direction that causes the corresponding tapered surfaces 120 of the cone segments 104 to ride up the tapered surface 118 of the inner mandrel 108 to a location having a greater outer diameter preloads the cone segments 104. This places the cone segments 104 in the extended position due to the interrelation of the tapered surfaces 118, 120.

The bias used to preload the cone segments 104 to the extended position comes from tension on the inner mandrel 108 and compression on the compression sleeve 112. Final make up of the preload sleeve 110 on the inner mandrel 108 establishes this tension and compression. Specifically, the final make up of the preload sleeve 110 shortens a distance between the bottom end of the preload sleeve 110 and a shoulder or stop 122 of the lower holder sleeve 115 in order to create the tension and compression.

Rotation of the preload sleeve 110 relative to the inner mandrel 108 threads external threads 126 of the inner mandrel 108 with internal threads 128 of the preload sleeve 110 to move the preload sleeve 110 axially along the inner mandrel 108 toward the stop 122. Initially, the compression sleeve 112, the upper holder sleeve 114 and the cone segments 104 all slide relative to the inner mandrel 108 as the preload sleeve 110 moves toward the stop 122. Once a shoulder 124 of the cone segments 104 contacts the stop 122, additional turns of the preload sleeve 110 begins creating a compressive load in the compression sleeve 112. The compressive load is translated through the upper holder sleeve 114 and cone segments 104 to the inner mandrel due to the stop 122 that is preventing further sliding since the lower holder sleeve 115 is locked to the inner mandrel 108. As a result, tension corresponding to the compression develops in the inner mandrel 108. Therefore, a set number of turns of the preload sleeve 110 past the point where contact of the cone segments 104 with the stop 122 first occurs establishes a desired preload force biasing the cone segments 104 to the extended position.

Figure 5:
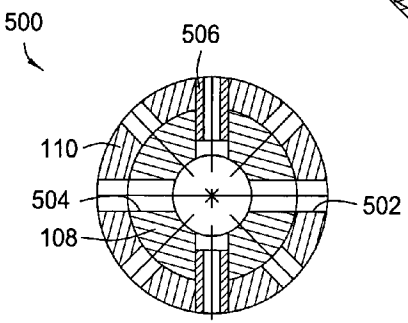
FIG. 5 is a cross section view taken across line 5-5 in FIG. 1 to illustrate a locking pin arrangement for selectively preventing movement between the inner mandrel and a preload sleeve.

FIG. 5 is a cross section view taken across line 5-5 in FIG. 1 to illustrate a locking pin arrangement 500 for selectively preventing movement between the inner mandrel 108 and the preload sleeve 110 once the desired preload force is established by rotation of the preload sleeve 110. The preload sleeve 110 includes eight slots 502 spaced around the circumference thereof. Four holes 504 spaced around the circumference of the inner mandrel 108 receive set pins 506 once a set of the slots 502 align therewith. The actual number of slots 502 and/or holes 504 depends on an acceptable amount of adjustment required to achieve alignment of the slot 502 with the hole 504 given the desired preload requirements. In order to further reduce the amount of adjustment required to align the locking pin arrangement 500, the inner mandrel 108 can include additional sets of the holes 504 axially offset and staggered from one another. Interference from the set pins 506 disposed in the holes 504 of the inner mandrel 108 and the slots 502 of the preload sleeve 110 provides a positive lock keeping vibration of the expander tool 100 from causing the preload sleeve 110 to rotate and thereby change the preload force applied to the cone segments 104 during operation. For some embodiments, the preload sleeve 110 locks relative to the inner mandrel 108 with other locking arrangements such as set screws or a weld.

Expansion of a length of the liner 102 progresses by moving the expander tool 100 through the liner 102. An axial pull force applied to the inner mandrel 108 achieves this movement. The pull force can come from a work string (not shown) connected to the inner mandrel 108 and extending to the surface of the well or any type of driving apparatus (not shown) capable of providing the necessary pull force.

Figure 6:
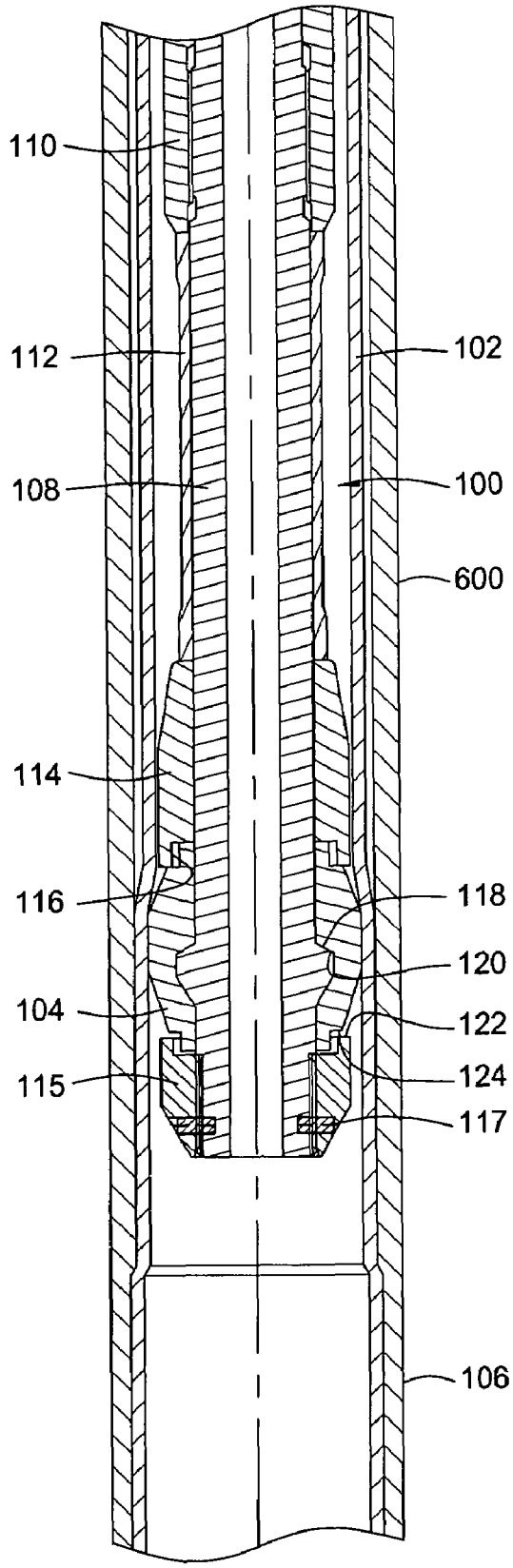
FIG. 6 is a longitudinal section view of the expander tool with the cone segments in a fully retracted position to expand the liner against an inside surface of a surrounding heavy weight casing having a smaller inner diameter than the light weight casing.

FIG. 6 shows the expander tool 100 upon reaching a restriction such as a section of heavy weight casing 600 having a smaller inner diameter than the light weight casing 106. The cone segments 104 move inward in a radial direction to a fully retracted position to expand the liner 102 against an inside surface of the surrounding heavy weight casing 600. For some embodiments, the fully retracted position of the cone segments 104 does not expand the liner 102 at all, i.e., the greatest outer diameter of the expander tool 100 with the cone segments 104 in the retracted position can be less than or equal to the inner diameter of the liner 102 prior to expansion.

At the heavy weight casing 600, the pull force required to move the expander tool 100 through the liner 102 increases as the cone segments 104 are caused to deflect inward to the retracted position. With the increased pull force and the heavy weight casing 600 limiting the expansion of the liner 102, the corresponding tapered surfaces 120 of the cone segments 104 slide down the tapered surface 118 of the inner mandrel 108 to a location with a smaller outer diameter. Thus, this movement requires overcoming the bias of the preload force, which results in increasing compression of the compression sleeve 112. The movement of the cone segments 104 subsequently reduces the outer diameter defined by the cone segments 104. In the retracted position of the cone segments 104, the compressive load from the compression sleeve 112 translates tension to the inner mandrel via the tapered surface 118 instead of the stop 122. The increased pull force remains within a maximum allowable for normal system operation.

The thickness, length, and composition of the compression sleeve 112 can be varied depending on the desired preload applied to the cone segments 104. Making the compression sleeve 112 thicker and longer can for example increase the yield point and change the spring rate of the compression sleeve 112. As the compression sleeve 112 becomes thicker, there is generally an increase in spring rate. Alternatively, the compression sleeve may have a tapered or non-uniform end to end thickness profile thereby providing a variable spring rate.

Figure 8:
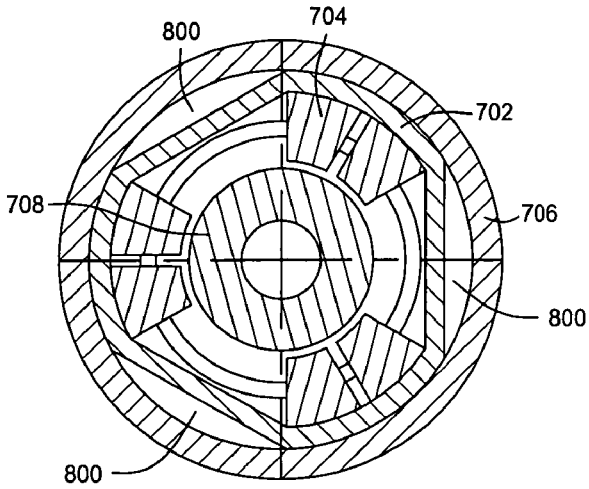
FIG. 8 is a cross section view taken across line 8-8 in FIG. 7 to illustrate the flow paths created due to the arrangement of the cone segments.
Figure 7:
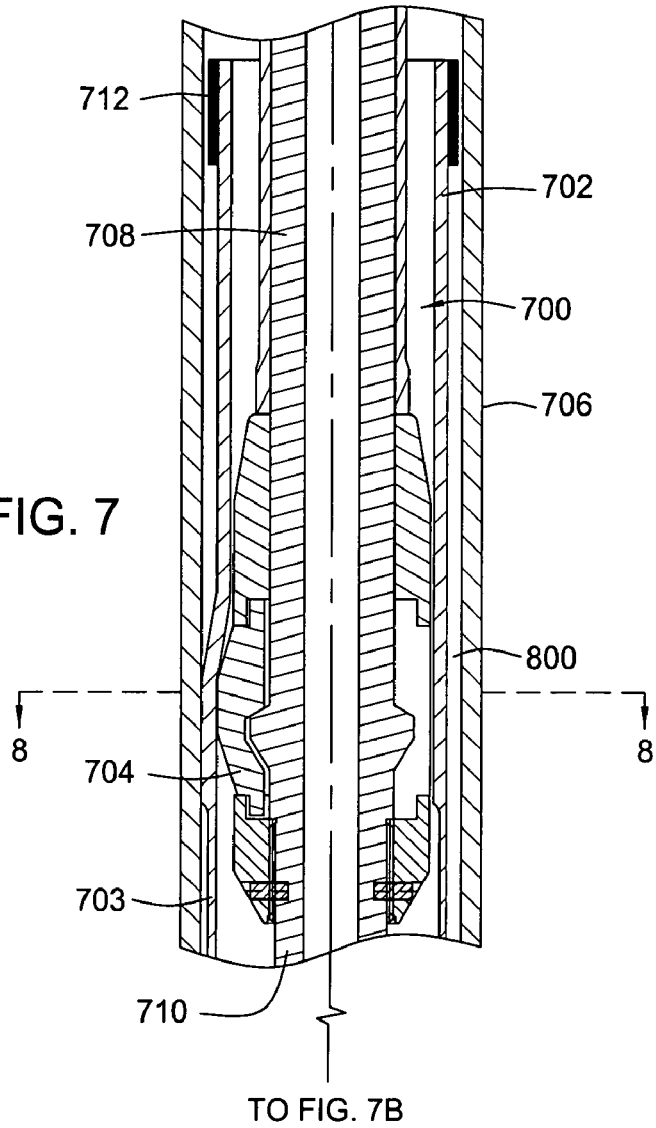
FIGS. 7 and 7B are longitudinal section views of an expansion assembly disposed in a liner with an expander tool for expanding discrete radial portions of the liner against an inside surface of a casing to hang the liner while leaving flow paths for fluid circulation.
Figure 7B:
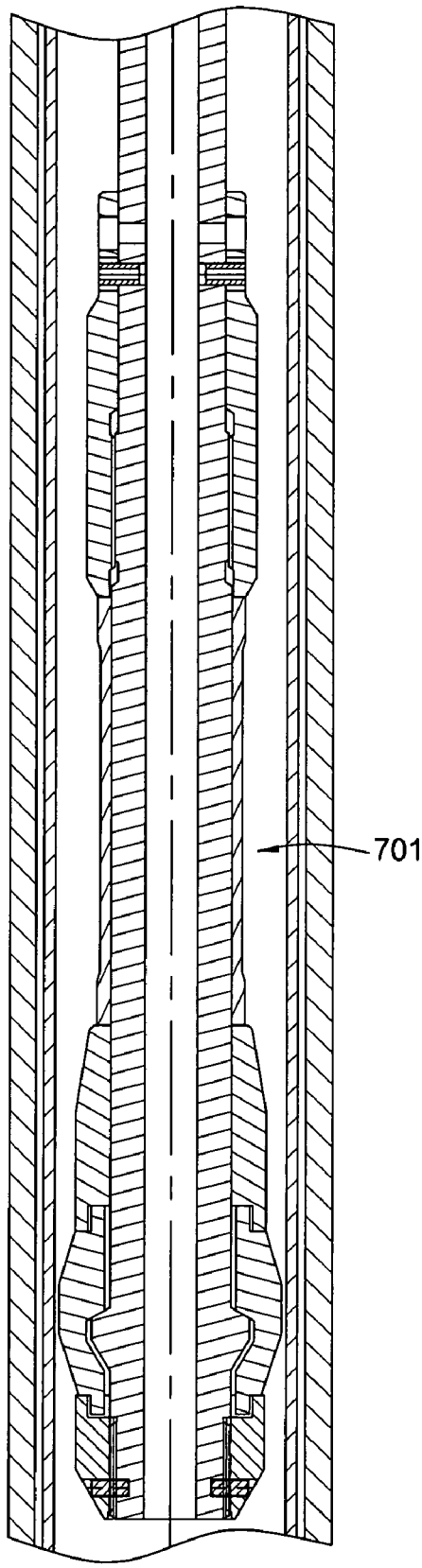

FIGS. 7, 7B and 8 illustrate an initial expander tool 700 adapted to expand discrete radial portions of a liner 702 against an inside surface of a casing 706 to hang the liner 702 while leaving flow paths 800 for fluid circulation. As such, these surfaces in frictional contact at an upper end of the liner 702 provide hanging support for the liner 702 during cementing procedures. Pumped cement and/or other fluid displaced by the cement can flow through an annulus surrounding the liner 702 and through the flow paths 800.

The initial expander tool 700 is similar in design and operation to the expander tool 100 shown in FIG. 1 except that cone segments 704 are spaced around an inner mandrel 708 with sufficient gaps between selected adjacent ones of the cone segments 704 such that an outer perimeter defined by the cone segments is non-circular. Radial outward expansion does not occur at these gaps, which correspond to the location of the flow paths 800. Thus, the liner 702 assumes a non-circular outer diameter within a circular inner diameter of the casing 706 in order to form the flow paths 800. As with other embodiments, the cone segments 704 can advantageously deflect inward to overcome any restrictions. Since other features and elements of the initial expander tool 700 are analogous to those already described herein, a detailed discussion of like elements and features is omitted.

Coupled to a back end 710 of the inner mandrel 708 behind the initial expander tool 700 may be an additional expander tool 701 such as the expander tool 100 shown in FIG. 1 that is configured to provide complete circumferential expansion of the liner 702. In operation, further movement of the additional expander tool 701 through the section of the liner 702 previously expanded by the initial expander tool 700 occurs at a desired time after the cementing procedures. This movement of the additional expander tool 701 through the upper end of the liner 702 expands the upper end of the liner 702 into complete circumferential contact with the casing 706, such as illustrated in FIG. 2. In order to further enhance sealing of the liner 702 to the casing 706 upon closing of the flow paths 800 with the additional expander tool 701, a sealing material 712 such as an elastomer can be disposed on an outside of the liner 702. With the arrangement shown for expanding in a bottom-up direction, the expander tools 700, 701 can be initially housed in an enlarged inner diameter section 703 of the liner 702 during running-in of the liner 702. In this manner, a relatively smaller inner diameter of the upper end of the liner 702 adjacent to and above the enlarged inner diameter section 703 of the liner 702 can be expanded with the initial expander tool 700 to hang the liner 702 in the casing 706 without requiring expansion of the entire length of the liner 702.

For some embodiments, the expander tools 100, 700, 701 may be oriented or flipped upside down such that expansion occurs in a top-down direction. In operation, a push force applied to the inner mandrel of the expander tool instead of the pull force is used move the expander tool through the tubular member to be expanded. The cone segments can still retract inward upon encountering a restriction by overcoming the same bias of the preload force, as described heretofore.

Embodiments of the invention described herein provide for a method of expanding a tubular member in a wellbore using an expander tool having a plurality of segments preloaded to an extended position by counteracting tension and compression within the expander tool. The counteracting tension and compression is created by a tubular sleeve of the expander tool being in compression. Moving the expander tool through the tubular member that has an inner diameter less than an outer diameter of the segments in the extended position expands the tubular member. During the moving, the segments travel within a range between the extended position and a retracted position in response to restrictions.

Additionally, embodiments of the invention described herein provide for a method of expanding a tubular member in a wellbore that includes providing first and second expander tools and the tubular member that has a substantially circular cross-section and expanding a first circumferential region along a length of the tubular member into contact with a surrounding surface such that a flow path remains through an annulus between the tubular member and the surrounding surface at a second circumferential region along the length of the tubular member not in contact with the surrounding surface. This initial expansion can secure or hang the tubular in the wellbore prior to circulating a fluid through the flow path created during the initial expansion. Thereafter, expanding the second circumferential region along at least a portion of the length of the tubular completes substantially full circumferential expansion thereof and closes the flow path. Expanding the first and second circumferential regions occurs by contacting the segments of the first and second expander tools, respectively, with an inside of the tubular member. The segments of the expander tools can be preloaded to extended positions and travel during the expanding within a range between the extended positions and reduced outer diameter retracted positions in response to restrictions. In operation, the first and second expander tools can be of the type described heretofore. Alternatively, one or both of the first and second expanders can be replaced with other suitable compliant expander tools such as an expander tool shown and described in U.S. Pat. No. 6,457,532, which is herein incorporated by reference.

While the foregoing is directed to embodiments of the present invention, other and further embodiments of the invention may be devised without departing from the basic scope thereof, and the scope thereof is determined by the claims that follow.

The invention claimed is:

1. An expander tool for expanding a wellbore tubular member, comprising:

an inner mandrel;

a plurality of cone segments disposed around the inner mandrel and movable in a radial direction between an extended position and a retracted position; and a tubular member disposed around the inner mandrel proximate an end of the plurality of cone segments, wherein compression in the tubular member and tension in the inner mandrel biases the plurality of cone segments to the extended position with a level of radial biasing force that is dependent on an amount of the compression and tension; and a preload sleeve threaded onto the inner mandrel, wherein rotation of the preload sleeve compresses the tubular member.

2. The expander tool of claim 1, wherein the plurality of cone segments are axially slidable with respect to a tapered surface of the inner mandrel for moving the plurality of cone segments in the radial direction.

3. The expander tool of claim 1, wherein the plurality of cone segments are separable from one another in a radial direction.

4. The expander tool of claim 1, wherein an outer perimeter defined by the plurality of cone segments is substantially non-circular.

5. The expander tool of claim 4, further comprising an expander assembly disposed behind the plurality of cone segments for providing complete circumferential expansion of the wellbore tubular member.

6. An expander tool for expanding a wellbore tubular, comprising:

an inner mandrel having a tapered surface about an outside diameter thereof;

retractable segments disposed around the inner mandrel and movable between an extended position and a retracted position, the retractable segments having corresponding tapered surfaces in contact with the tapered surface of the inner mandrel; and a compression sleeve disposed around the inner mandrel, wherein a compressive load on the compression sleeve preloads the retractable segments to a raised position on the tapered surface and hence the extended position, and wherein the compression sleeve is held around the inner mandrel in compression between first and second fixed points along a length of the inner mandrel, the first fixed point restricts axial sliding of the compression sleeve relative to the inner mandrel in a first direction and the second fixed point restricts axial sliding of the cone segments relative to the inner mandrel in a second direction.

7. The expander tool of claim 6, wherein a first end of the compression sleeve is restricted from axial movement with respect to the inner mandrel and a second end of the compression sleeve moves axially with the retractable segments within a range of axial movement of the retractable segments.

8. The expander tool of claim 7, further comprising a preload sleeve threaded to the inner mandrel and abutting the first end of the compression sleeve.

9. The expander tool of claim 8, wherein the preload sleeve includes a locking arrangement for selectively preventing movement with respect to the inner mandrel.

10. The expander tool of claim 6, further comprising:

a preload sleeve threaded to the inner mandrel and abutting a first end of the compression sleeve; and a holder sleeve abutting a second end of the compression sleeve, wherein the holder sleeve receives a portion of retractable segments.

11. The expander tool of claim 6, wherein the retractable segments are separable from one another in a radial direction.

12. The expander tool of claim 6, wherein the extended position of the retractable segments provides a maximum outer diameter of the expander tool that is greater than that provided with the retractable segments in the retracted position.

13. The expander tool of claim 6, further comprising a holder sleeve for guiding the retractable segments in a radial direction, the holder sleeve having slots in an inner diameter thereof that house tabs extending from ends of the retractable segments.

14. A method of expanding tubing in a wellbore, comprising:

providing an expander tool having a plurality of segments preloaded to an extended position by counteracting tension within an inner mandrel and compression within a tubular member of the expander tool; and moving the expander tool through the tubing that has an inner diameter less than an outer diameter of the segments in the extended position to expand the tubing, wherein during the moving in response to restrictions the segments travel within a range between the extended position and a retracted position defining a reduced outer diameter.

15. The method of claim 14, wherein during the moving and in response to the restrictions the segments travel from the extended position toward the retracted position defining the reduced outer diameter and then back toward the extended position.

16. The method of claim 3, wherein the counteracting tension and compression within the expander tool thereby produces a preloading radial force on the plurality of segments with a level of the force dependent on an amount of the compression.

17. The method of claim 16, wherein the force occurs during expansion of the tubular.

18. A method of expanding a tubular member in a wellbore, comprising:

providing first and second expander tools and the tubular member that has a substantially circular cross-section;

expanding a first circumferential region along a length of the tubular member into contact with a surrounding surface such that a flow path remains through an annulus between the tubular member and the surrounding surface at a second circumferential region along the length of the tubular member not in contact with the surrounding surface, wherein expanding the first circumferential region occurs by contacting first segments of the first expander tool with an inside of the tubular member;

circulating a fluid through the flow path; and expanding the second circumferential region along at least a portion of the length of the tubular to complete substantially full circumferential expansion thereof and close the flow path, wherein expanding the second circumferential region occurs by contacting second segments of the second expander tool with the inside of the tubular member, wherein the segments of the expander tools are preloaded to extended positions and travel during the expanding within a range between the extended positions and reduced outer diameter retracted positions in response to restrictions, and wherein the segments of the expander tools are preloaded to the extended positions by counteracting tension and compression created within each of the expander tools by a respective tubular sleeve being in compression.

19. The method of claim 18, wherein circulating the fluid through the flow path comprises circulating cement.

20. The method of claim 18, wherein expanding the first circumferential region along the length of the tubular member hangs the tubular member within casing and completion of the expanding seals the annulus.

21. An expander tool for expanding a wellbore tubular member, comprising:

an inner mandrel;

a plurality of cone segments disposed around the inner mandrel and movable in a radial direction between an extended position and a retracted position; and a tubular member disposed around the inner mandrel proximate an end of the plurality of cone segments and secured relative to the inner mandrel to lock in compression and tension within the tubular member and inner mandrel, respectively, wherein the compression and tension within the inner mandrel and tubular member biases the plurality of cone segments to the extended position with a level of radial biasing force that is dependent on an amount of the compression and tension.

* * * * *

UNITED STATES PATENT AND TRADEMARK OFFICE

CERTIFICATE OF CORRECTION

PATENT NO. : 7,434,622 B2
APPLICATION NO. : 11/181253
DATED : October 14, 2008
INVENTOR(S) : Luke et al.

It is certified that error appears in the above-identified patent and that said Letters Patent is hereby corrected as shown below:

In the Claims:

Column 8, Claim 16, Line 6, please delete "3" and insert --14-- therefor.

Signed and Sealed this

Third Day of March, 2009

John Doll

JOHN DOLL
*Acting Director of the United States Patent and Trademark Office*